US010165909B2

(12) United States Patent
Tanguay et al.

(10) Patent No.: US 10,165,909 B2
(45) Date of Patent: Jan. 1, 2019

(54) MULTI-LINER ASSEMBLY FOR A BODY LIQUID RECEPTACLE AND A BODY LIQUID RECEPTACLE INCLUDING SAME

(71) Applicant: HY-INDUSTRIE INC., Drummondville (CA)

(72) Inventors: Eric Tanguay, Candiac (CA); Eric Pelletier, St-Cyrille-de-Wendover (CA)

(73) Assignee: HY-INDUSTRIE INC., Drummondville (CA)

( * ) Notice: Subject to any disclaimer, the term of this patent is extended or adjusted under 35 U.S.C. 154(b) by 30 days.

(21) Appl. No.: 15/257,326

(22) Filed: Sep. 6, 2016

(65) Prior Publication Data

US 2017/0065134 A1 Mar. 9, 2017

Related U.S. Application Data

(60) Provisional application No. 62/213,995, filed on Sep. 3, 2015.

(51) Int. Cl.

| | |
|---|---|
| ***A47K 11/10*** | (2006.01) |
| ***A47K 11/02*** | (2006.01) |
| ***A61G 9/00*** | (2006.01) |
| ***A61J 19/00*** | (2006.01) |
| ***A47K 11/06*** | (2006.01) |

(52) U.S. Cl.

CPC ..... *A47K 11/02* (2013.01); *A47K 11/06* (2013.01); *A47K 11/105* (2013.01); *A61G 9/003* (2013.01); *A61G 9/006* (2013.01); *A61J 19/00* (2013.01)

(58) Field of Classification Search

CPC ..... A47K 11/06; A47K 11/105
USPC ..... 4/450–458
See application file for complete search history.

(56) References Cited

U.S. PATENT DOCUMENTS

| | | | | |
|---|---|---|---|---|
| 3,249,950 | A * | 5/1966 | Wilson | A61G 9/003 4/452 |
| 3,763,502 | A | 10/1973 | Keoseian | |
| 3,906,555 | A | 9/1975 | Scott et al. | |
| 3,936,890 | A | 2/1976 | Oberstein | |
| 4,011,606 | A | 3/1977 | Scrafield et al. | |

(Continued)

FOREIGN PATENT DOCUMENTS

| | | |
|---|---|---|
| CA | 131044 | 5/2010 |
| CA | 135592 | 5/2010 |

(Continued)

*Primary Examiner* — Christine Skubinna
(74) *Attorney, Agent, or Firm* — Price Heneveld LLP

(57) ABSTRACT

A multi-liner assembly for lining a body liquid receptacle includes a plurality of lining units superimposed on one another and engageable with the body liquid receptacle to line a cavity formed therein. Each of the plurality of lining units includes an impermeable layer having a top side with an absorbent material superposed thereon. When the multi-liner assembly is engaged with the body liquid receptacle, a topmost one of the plurality of lining units is exposed and is individually removable from the multi-liner assembly to leave a subsequent one of the plurality of lining units exposed. A multi-liner assembly including a rigid support removably engageable with a body liquid receptacle is also provided. When a rigid support is engaged with the body liquid receptacle, the top side of at least one lining unit is exposed and positioned to line a cavity formed in the body liquid receptacle.

20 Claims, 8 Drawing Sheets

(56) References Cited

U.S. PATENT DOCUMENTS

| | | | | |
|---|---|---|---|---|
| 4,136,798 | A | 1/1979 | Oberstein | |
| 4,343,053 | A | 8/1982 | O'Connor | |
| 4,759,086 | A | 7/1988 | Booth-Cox | |
| 4,827,540 | A | 5/1989 | Stokes | |
| 4,882,794 | A | 11/1989 | Stewart, III | |
| 5,155,871 | A | 10/1992 | Sams | |
| 5,455,972 | A | 10/1995 | Williams | |
| 6,523,187 | B1 * | 2/2003 | Brink | A47K 11/06 383/37 |
| D627,062 | S | 11/2010 | Tanguay | |
| D677,383 | S | 3/2013 | Morand et al. | |
| 8,869,318 | B2 | 10/2014 | Tanguay | |
| 2003/0159207 | A1 | 8/2003 | Howell | |
| 2007/0192948 | A1 | 8/2007 | Ernest et al. | |
| 2010/0263118 | A1 | 10/2010 | Tanguay | |
| 2014/0082832 | A1 | 3/2014 | Marshall | |
| 2016/0106609 | A1 | 4/2016 | Russell | |

FOREIGN PATENT DOCUMENTS

| | | | |
|---|---|---|---|
| CA | 142867 | | 5/2012 |
| CA | 2708598 | C | 11/2015 |
| CN | 2211805 | Y | 11/1995 |
| EP | 0948304 | B1 | 4/2005 |
| FR | 1551239 | A | 12/1968 |
| FR | 2345990 | A2 | 12/1969 |
| FR | 2654929 | A1 | 5/1991 |
| FR | 2751529 | A1 | 1/1998 |
| FR | 2852822 | A1 | 10/2004 |
| GB | 2248180 | A | 4/1992 |
| GB | 2470765 | A | 12/2010 |
| WO | 8601098 | A1 | 2/1986 |
| WO | 9011714 | A1 | 10/1990 |
| WO | 9804230 | A1 | 2/1998 |
| WO | 9949770 | A1 | 10/1999 |

* cited by examiner

MULTI-LINER ASSEMBLY FOR A BODY LIQUID RECEPTACLE AND A BODY LIQUID RECEPTACLE INCLUDING SAME

CROSS-REFERENCE TO RELATED APPLICATIONS

This application claims priority from U.S. Provisional Application No. 62/213,995, filed on Sep. 3, 2016, the entirety of which is incorporated herein by reference.

TECHNICAL FIELD

The technical field relates to a body liquid receptacle such as a bedpan, a urinal device, or an emesis (vomit) container which is designed to receive a lining unit for collecting and disposing human body liquids. It also relates to a receptacle liner assembly to be engageable with a body liquid receptacle.

BACKGROUND

Body liquid receptacles are commonly used to aid in the collection and disposal of various types of human body liquids, particularly in health and geriatric care facilities. Such receptacles can take a number of different forms depending on their intended use and the type of body liquid they are designed to collect.

Typically, body liquid receptacles include a cavity which can hold collected body liquid until the liquid can be safely disposed. In most cases, body liquid receptacles are reusable, but must be thoroughly cleaned between uses for sanitary purposes. Disadvantageously, cleaning a body liquid receptacle effectively can be time consuming and can pose certain health risks, for example when contagious illnesses are involved.

Some improvements have been proposed to address these issues. For example, some body liquid receptacles are designed to be for one-time use, and thus disposed following the collection of body liquid, thereby eliminating the cleaning step. Disadvantageously, this can be wasteful and costly, especially when contagious illnesses are not a high concern. Alternatively, the body liquid receptacle can be wrapped in a disposable lining before use. Once the body liquid has been collected, the lining can be removed with the body liquid contained therein, and the lining can be disposed. The body liquid receptacle can then be lined with a new disposable lining for subsequent use.

While the use of a disposable lining is practical and involves minimal waste, there is still room for improvement. For example, it is preferred that the processes of wrapping the body liquid receptacle before use and removing the lining after use be simplified as much as possible. There is therefore a need for a body liquid receptacle which addresses at least some of these issues.

SUMMARY

According to an aspect, a multi-liner assembly for lining a body liquid receptacle is provided. The multi-liner assembly includes a plurality of lining units superimposed on one another and engageable with the body liquid receptacle to line a cavity formed therein, each of the plurality of lining units including an impermeable layer having a top side with an absorbent material superposed thereon, wherein, when the multi-liner assembly is engaged with the body liquid receptacle, a topmost one of the plurality of lining units is exposed and is individually removable from the multi-liner assembly to leave a subsequent one of the plurality of lining units exposed.

In an embodiment, at least one of the lining units includes an attachment mechanism configured to removably secure the at least one lining unit to the body liquid receptacle.

In an embodiment, the attachment mechanism includes an elastic extending at least partially around a peripheral region of the at least one lining unit.

In an embodiment, the attachment mechanism includes an adhesive exposed on a bottom side of the at least one lining unit.

In an embodiment, each of the plurality of lining units includes at least one removal tab extending from a periphery thereof, the removal tab of at least the topmost lining unit being exposed when the multi-liner assembly is engaged with the body liquid receptacle.

In an embodiment, each of the plurality of lining units includes a closure mechanism operable to close the lining unit and enclose the absorbent material therein.

In an embodiment, each of the plurality of lining units includes a first end and a second end, and the closure mechanism includes an adhesive provided in at least one of the first and second ends of the lining unit, the lining unit being closable by folding the first end over the absorbent material and towards the second end, and securing the first and second ends together using the adhesive.

In an embodiment, each of the lining units includes a bottom section insertable into the cavity of the body liquid receptacle, and an upper section shaped to wrap around a seat section of the body liquid receptacle to engage therewith.

In an embodiment, the multi-liner assembly further includes a rigid support under a bottommost one of the lining units, said rigid support supporting the plurality of lining units and being removably engageable with the body liquid receptacle.

According to an aspect, a liner assembly for lining a body liquid receptacle is provided. The liner assembly includes: a rigid support removably engageable with the body liquid receptacle; and at least one lining unit supported by the rigid support, the at least one lining unit including an impermeable layer having a top side with an absorbent material superposed thereon, wherein, when the rigid support is engaged with the body liquid receptacle, the top side of the at least one lining unit is exposed and positioned to line a cavity formed in the body liquid receptacle.

In an embodiment, the rigid support is at least partially complementary in shape to the body liquid receptacle with which it engages.

In an embodiment, the rigid support is substantially ring shaped.

In an embodiment, the rigid support includes a metallic or rigid plastic ring.

In an embodiment, the rigid support includes a peripheral wall section and a rim section and, when the rigid support is engaged with the body liquid receptacle, said peripheral wall section and rim section are superposed to a corresponding peripheral wall and rim in the body liquid receptacle.

In an embodiment, the rigid support has a cavity defined therein and the lining units are positioned to cover said cavity, and wherein the cavity of the rigid support is aligned with the cavity of the body liquid receptacle when the rigid support is engaged therewith, the lining units thereby covering the cavity of the body liquid receptacle when the body liquid receptacle is engaged with the rigid support.

In an embodiment, the cavity in the rigid support is defined by a peripheral wall section and, when the rigid support is engaged with the body liquid receptacle, said peripheral wall section is superposed to a corresponding peripheral wall in the body liquid receptacle.

In an embodiment, the rigid support includes a seat member section, and wherein when the rigid support is engaged with the body liquid receptacle, the seat member section is superposed to a seat member of the body liquid receptacle.

In an embodiment, the rigid support includes a body made of a molded plastic or pulp.

In an embodiment, the at least one lining unit includes a plurality of lining units superimposed on one another, wherein, when the liner assembly is engaged with the body liquid receptacle, a topmost one of the plurality of lining units is exposed, said topmost one of the plurality of lining units being individually removable from the liner assembly to leave a subsequent one of the plurality of lining units exposed.

According to an aspect, a body liquid receptacle assembly is provided. The assembly includes a body liquid receptacle having a body with a cavity defined therein, and a multi-liner assembly removably engaged with the body liquid receptacle, the multi-liner assembly includes a plurality of lining units superimposed on one another and engaged with the body liquid receptacle to line the cavity, each of the plurality of lining units includes an impermeable layer having a top side with an absorbent material superimposed thereon, wherein a topmost one of the plurality of lining units is exposed and is individually removable from the multi-liner assembly to leave a subsequent one of the plurality of lining units exposed.

DETAILED DESCRIPTION

Although the embodiments of the body liquid receptacle and multi-liner assembly and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the body liquid receptacle and multi-liner assembly, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Figure 1:
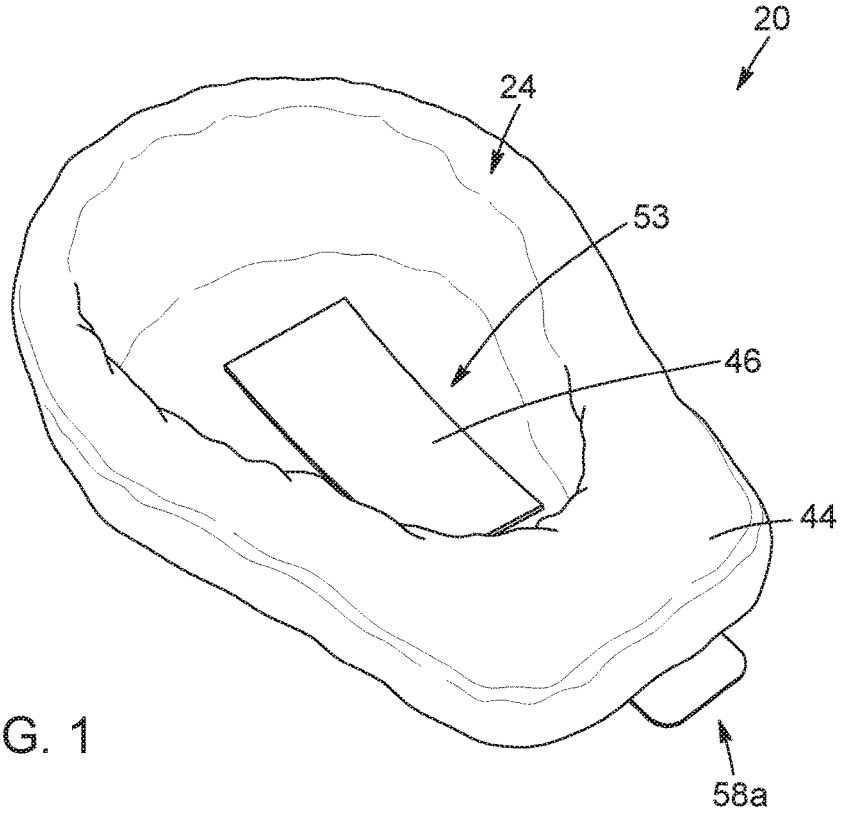
FIG. 1 is a top perspective view of a bedpan having a multi-liner assembly engaged therewith in accordance with an embodiment.
Figure 2:
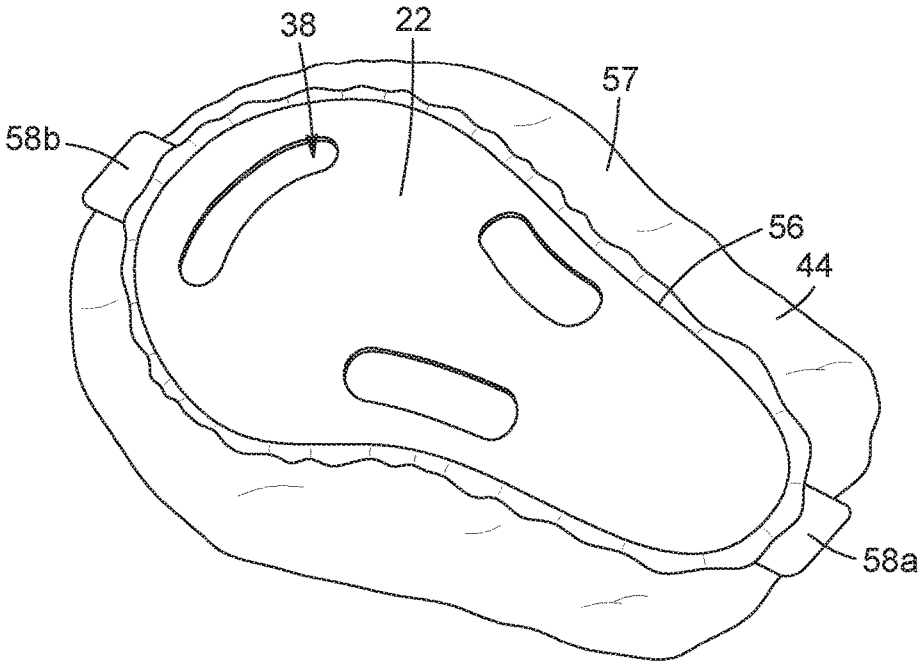
FIG. 2 is a bottom perspective view of the bedpan of FIG. 1 with the multi-liner assembly engaged therewith.
Figure 3:
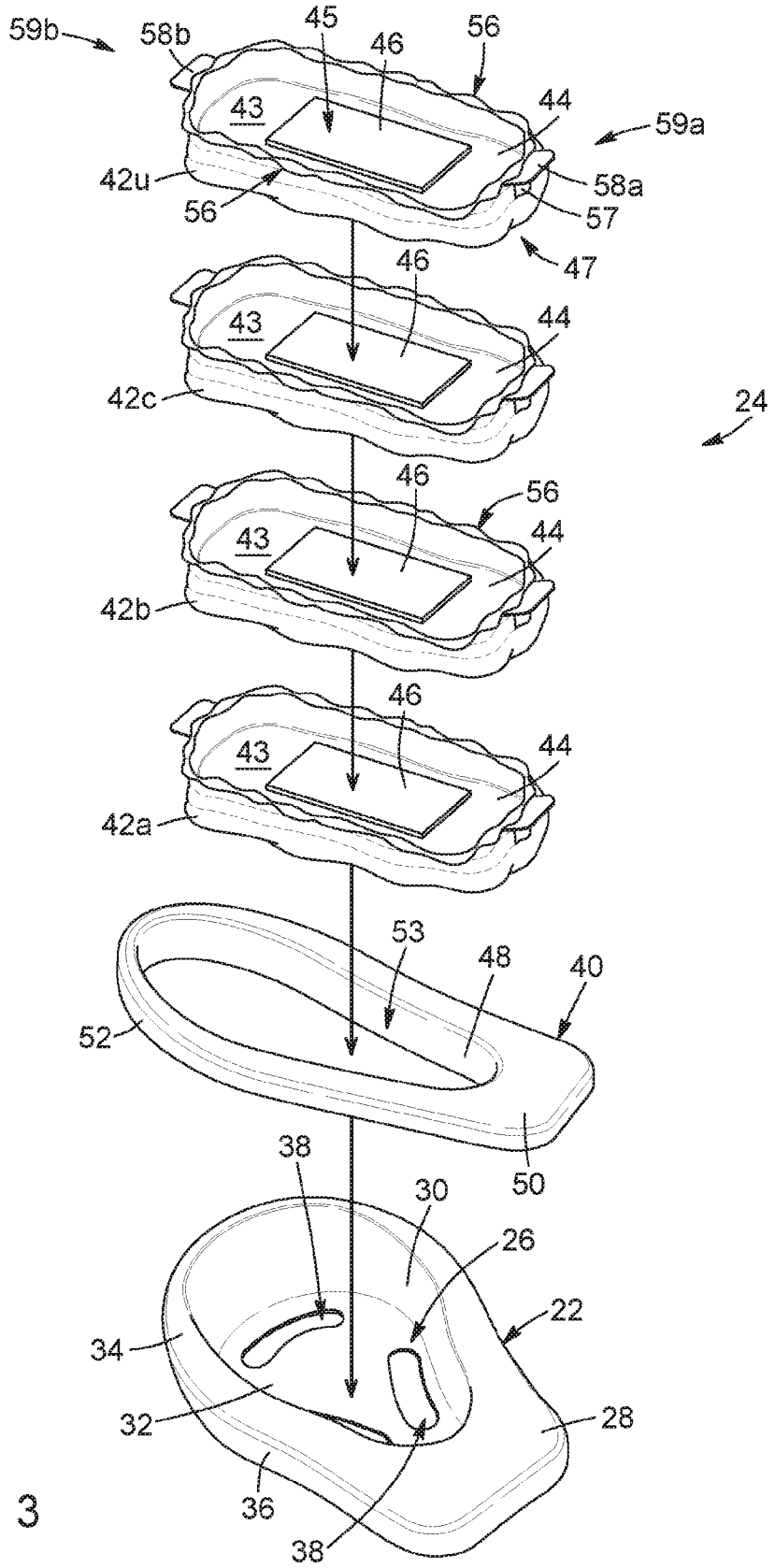
FIG. 3 is an exploded view of the multi-liner assembly and bedpan shown in FIG. 1.

Referring now to the drawings and, more particularly referring to FIGS. 1 and 2, there is shown a body liquid receptacle assembly 20 including a multi-liner assembly 24 engaged with a body liquid receptacle 22 (shown separately in the exploded view of FIG. 3). In the illustrated embodiment, the multi-liner assembly 24 is engaged with the body liquid receptacle 22 such that it completely covers upper and side portions of body liquid receptacle 22, thereby protecting the body liquid receptacle 22 for sanitary purposes.

In an embodiment, the multi-liner assembly 24 is detachably engaged with the body liquid receptacle 22. As shown in the exploded view of FIG. 3, the body liquid receptacle 22 defines a body liquid receiving cavity 26. In the present embodiment, the cavity 26 is partially closed, in that it includes a bottom wall 32 with apertures 38 defined therein. However, it should be appreciated that in other embodiments, the cavity can be opened in a bottom thereof (i.e. bottomless, without a bottom wall 32), or closed (i.e. it includes bottom wall 32 without apertures 38). In the engaged configuration, the multi-liner assembly 24 at least partially lines the body liquid receiving cavity 26 to receive and contain body liquids received therein, as will be described in more details below. In the embodiment shown in FIGS. 1 and 2, the multi-liner assembly 24 entirely lines the body liquid receiving cavity 26, and entirely covers exterior surfaces of the body liquid receptacle 22 on a top side thereof.

Referring again to FIG. 3, in the embodiment shown, the body liquid receptacle 22 is a bedpan with a receptacle body 28 having a peripheral wall 30 and the bottom wall 32 together defining the cavity 26, and a seat member 34 extending peripherally outwardly from an upper edge of the peripheral wall 30. In the embodiment shown, the seat member 34 peripherally surrounds the cavity 26. However, in an alternative embodiment, the seat member 34 can partially surround the cavity 26. In the embodiment shown, the seat member 34 peripherally ends with a rim 36, spaced-apart from the peripheral wall 30.

In the embodiment shown, the bottom wall 32 includes a plurality of apertures 38 defined therein. As can be appreciated, these apertures can act as handles to aid in maneuvering the bedpan to position it correctly for use. It is appreciated that the shape, the number and the configuration of the apertures can vary from the embodiment shown. Moreover, as mentioned above, in an alternative embodiment, the bottom wall 32 can be free of apertures or the bedpan can be free of bottom wall 32 closing the cavity 26.

As it will be appreciated, the body liquid receptacle 22 can differ from the bedpan shown in the accompanying figures. In alternative embodiments, the body liquid receptacle 22 can be a urinal device designed and conceived to receive urine or an emesis (vomit) container designed and conceived to receive emesis. It is appreciated that the shape of the body liquid receptacle will vary from the embodiment shown depending on its intended use.

Referring back to FIGS. 1 and 2, there is shown that, in the engaged configuration, the body liquid receptacle 22 is at least partially covered by the multi-liner assembly 24. In the embodiment shown, in the engaged configuration, the multi-liner assembly 24 covers (lines) the cavity 26 and an upper surface of the seat member 34. As mentioned above, the purpose of the multi-liner assembly 24 is to cover an outer surface of the body liquid receptacle 22, and receive and contain body liquid received in the cavity 26 of the body liquid receptacle 22.

Figure 4:
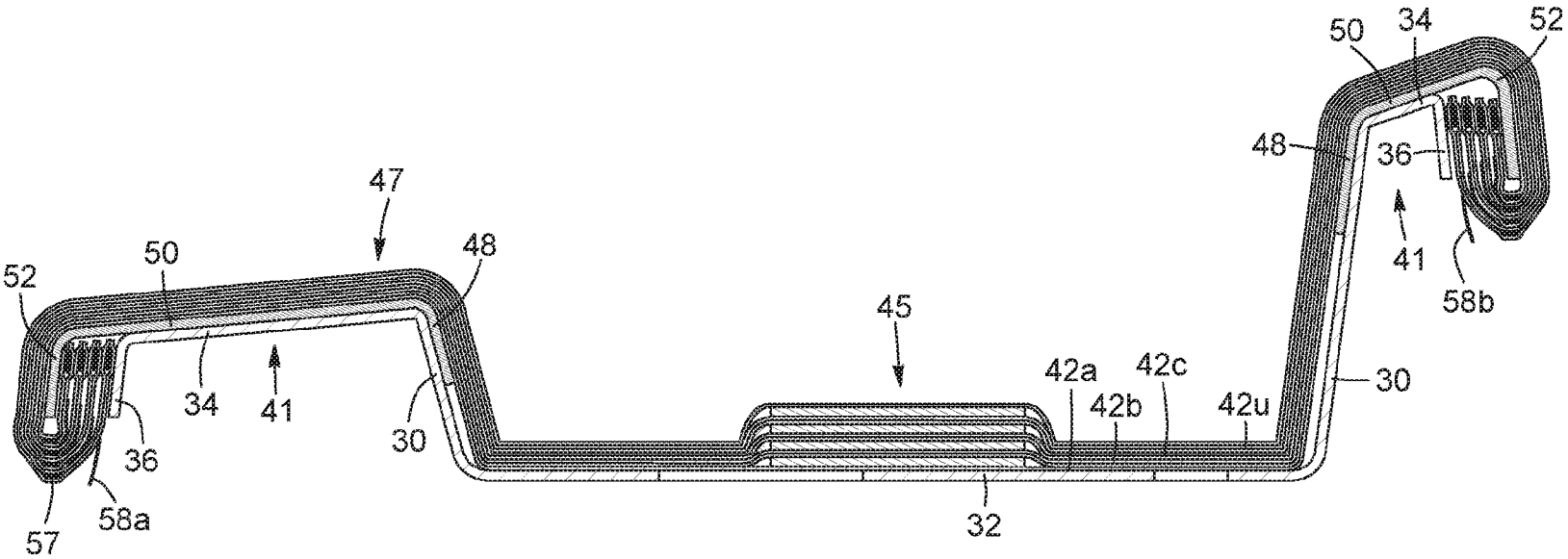
FIG. 4 is a cross-sectional view of the bedpan of FIG. 1 with the multi-liner assembly engaged therewith.

Referring to FIGS. 3 and 4, there is shown that, in an embodiment, the multi-liner assembly 24 includes a substantially rigid receptacle engagement support 40 and a plurality of superposed lining units 42*a*, 42*b*, 42*c*, 42*u* supported by the receptacle engagement support 40. Each one of the lining units 42*a*, 42*b*, 42*c*, 42*u* includes a liquid impermeable layer or cover 44, such as a plastic film, and an absorbent material layer (or pad) 46 superposed to an upper surface 43 of the lining unit 42, for example on a top side of the impermeable layer 44. As can be appreciated, when the lining units 42*a*-42*u* are superposed on one another, an absorbent material layer 46 extends between the liquid impermeable covers 44 of two consecutive lining units.

The receptacle engagement support 40 can have a shape which partially reproduces the shape of the body liquid receptacle 22 to be engageable therewith. For example the rigid support 40 can comprise one or several U-shaped elements 41 configured to engage around an interior or exterior of the receptacle. In other embodiments, the rigid support 40 can alternatively or additionally comprise protrusions and/or apertures for engaging with complementary protrusions and/or apertures in the body liquid receptacle 22. In the embodiment shown, the receptacle engagement support 40 includes a U-shaped element 41 comprising a peripheral wall section 48, a seat member section 50, and a rim section 52. The support 40 is substantially ring-shaped, as it runs continuously along a contour of seat member 34. The support 40 is engageable by superposition to the peripheral wall 30, the seat member 34, and the rim 36 of the body liquid receptacle 22. The peripheral wall section 48 defines a cavity 53 which is aligned with the cavity 26 of the body liquid receptacle 22, when engaged therewith. In the present embodiment, the cavity 53 of the engagement support is open in that it does not include a bottom wall; the engagement support 40 is thus substantially ring-shaped with a U-shaped cross-section. However, it is appreciated that in other embodiments, the cavity 53 can be closed or partially closed by having a bottom wall or part of a bottom wall.

It should be appreciated that other shapes and configurations of the support 40 are also possible. For example, instead of having a U-shaped cross section, support 40 can be a substantially flat ring formed with only seat member section 50. Lining units 42 can be adhered to a top surface of the flat ring, while a bottom surface of the flat ring can be adhered to support 40, for example using an adhesive, or by providing protrusions and/or apertures complementary to protrusions and apertures in seat member 34 of receptacle 22. In other alternative implementations, the support 40 can be a ring formed only with a peripheral wall section 48 or a rim section 52.

In an embodiment, the receptacle engagement support 40 is substantially rigid to maintain its shape when disengaged from the body liquid receptacle 22. For instance and without being limitative, it can be made of plastics or molded fiber or pulp, such as cellulose fiber or cardboard. In some embodiments, the rigid support can comprise a metallic or plastic wire which reproduces a contour of the body liquid receptacle 22. The lining units 42*a*-42*u* can thus be attached to the wire, which can maintain a shape of the multi-liner assembly at least until it is engaged with the body liquid receptacle 22 (for example, the wire can maintain the lining units 42 in an open or extended configuration so that it can easily fit over the receptacle 22). In other embodiments, instead of being a continuous ring, support 40 can be made of one or several separate elements for engaging the multi-liner assembly 24 with the receptacle 22. For example, support 40 can comprise one or several clips (or other attachment mechanisms) which are positioned to removably attach to a particular portion of receptacle 22, such as a U-shaped element which only extends along a small segment, or a partial contour of seat member 34. In some embodiments, support 40 can serve to align multi-liner assembly 24 in a proper position on receptacle 22, and the assembly 24 can be engaged with the receptacle using other attachment mechanisms, for example by folding lining units 42 around rim section 36.

In the engaged configuration of the multi-liner assembly 24 with the body liquid receptacle 22, the receptacle engagement support 40 is engaged with the body liquid receptacle 22. In an embodiment, the receptacle engagement support 40 is removably engageable with the body liquid receptacle 22. In the embodiment shown, in the engaged configuration, the peripheral wall section 48, the seat member section 50, and the rim section 52 of the receptacle engagement support 40 are superposed to the respective one of the peripheral wall 30, the seat member 34, and the rim 36 of the body liquid receptacle 22.

As mentioned above, the multi-liner assembly 24 includes a plurality of superposed lining units 42*a*, 42*b*, 42*c*, 42*u*, which are supported by the receptacle engagement support 40. The lining units 42 are said to be superposed in that they are positioned one on top of the other in a stacked configuration. The liquid impermeable covers 44 of the lining units 42*a*, 42*b*, 42*c*, 42*u* extend above the receptacle engagement support 40 and are engaged therewith. In the embodiment shown, the liquid impermeable covers 44 cover the peripheral wall section 48, the seat member section 50, and the rim section 52 and extends in the cavity 53 defined by the peripheral wall section 48. Thus, when the multi-liner assembly 24 is engaged with the body liquid receptacle 22, the superposed lining units 42, and more particularly the liquid impermeable covers 44 line (or cover) the cavity 26 of the body liquid receptacle 22.

Figure 8A:
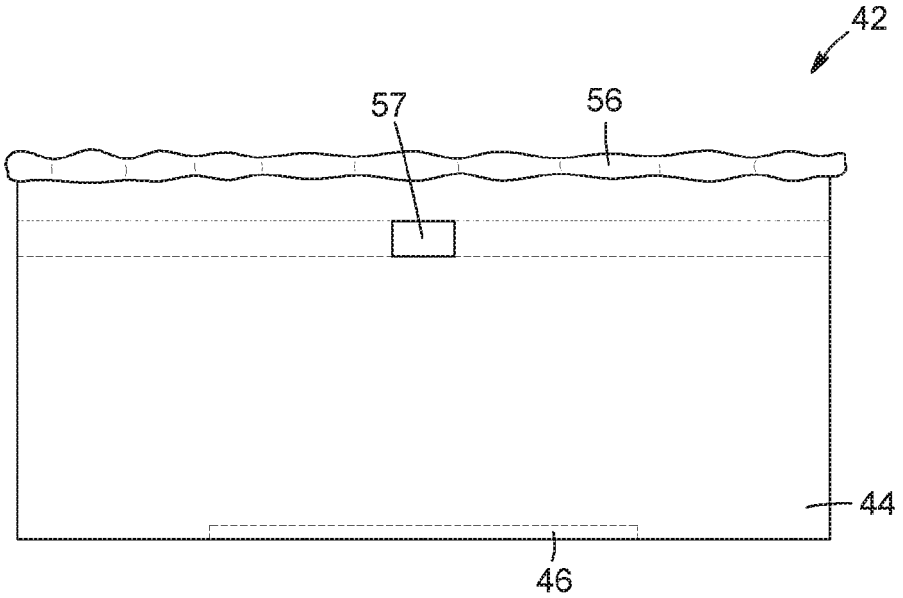
FIG. 8A is a front view of an individual lining unit in a folded configuration, in accordance with an embodiment in which the lining unit is closeable via a draw string.
Figure 8B:
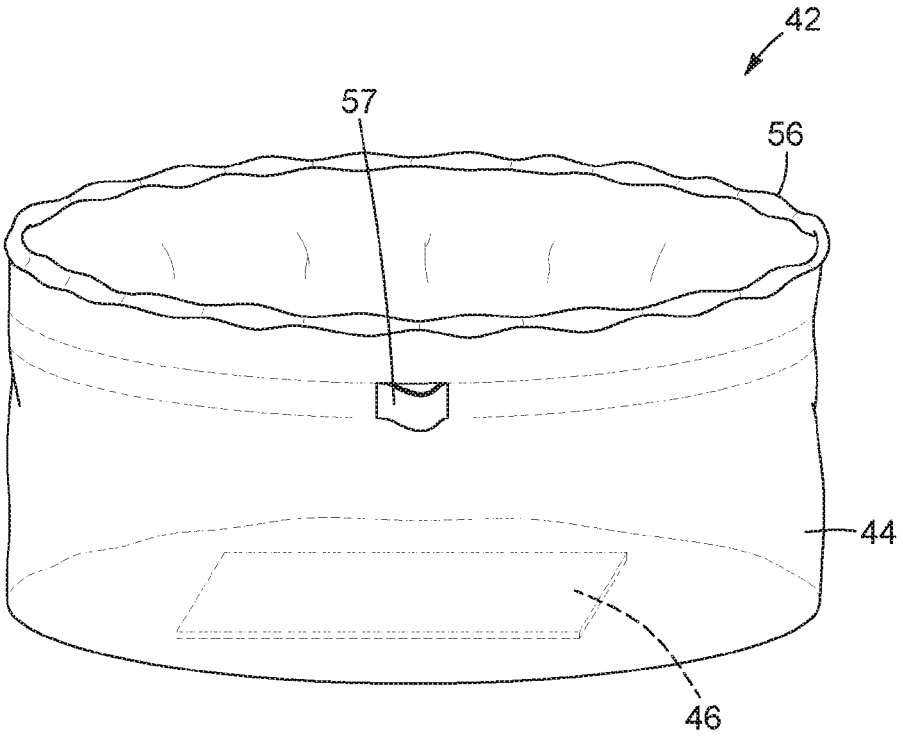
FIG. 8B is a perspective view of the lining unit of FIG. 8B in an open configuration.

In the embodiment shown, and also as shown in FIG. 8B, each one of the lining units 42 has an overall bag shape to have a bottom section 45 insertable in the cavity 26 and an upper section 47 which can be wrapped around the seat member section 50. For example, when the lining units 42 are extended as shown in FIG. 3 and FIG. 8B, bottom section 45 can be a central section containing absorbent material 46, and upper section 47 can be an outer peripheral region containing elastic 56 and/or drawstring 57. However, it is appreciated that in an alternative embodiment (not shown), the shape of the liquid receptacle 22 (including the shape of the peripheral wall section 48, seat member section 50, rim section 52, or other sections) can vary from the embodiment shown, and the shape of the lining units 42 can vary accordingly.

The liquid impermeable cover 44 is made of a liquid-proof material, such as and without being limitative a plastic film. In an embodiment, it is sized to at least partially cover the cavity 26 of the body liquid receptacle 22.

Preferably, at least one of the lining units 42 comprises an attachment mechanism for securing the lining unit 42 to the body liquid receptacle 22. In the present embodiment, each one of the lining units 42 has an attachment mechanism which comprises an elastic band 56 in a peripheral region thereof, close to a free edge. More particularly, an elastic band 56 surrounds peripherally each one of the lining units 42. In an alternative embodiment, the elastic band 56 can partially surround peripherally the lining units 42. For instance, the elastic band 56 can include two or more elastic band sections extending along longitudinal sides of each one of the lining units 42. The elastic band 56 is designed to engage the rim section 52 of the receptacle engagement support 40 by maintaining the peripheral region of the lining unit 42 under the rim section 52, as shown in FIG. 4, thereby wrapping the seat member section 50. In the present embodiment, each of the lining units 42 is thus secured to the body liquid receptacle 22 by first engaging with the engagement support 40 via the elastic bands 56, and then to the body liquid receptacle 22 via the engagement support 40. In alternate embodiments, the lining units 42 can secure to the body liquid receptacle 22 directly, for example by omitting the engagement support 40 and wrapping the elastic band 56 directly around the rim section 36 of body liquid receptacle 22.

As can be appreciated, properties of elastic 56, such as its tension, length, position, configuration, etc. can vary to attach more or less tightly to the engagement support 40, to attach it to different sections thereof, or to have the elastic 56 perform other functions. For example, in some embodiments, the elastic band 56 can alternatively or additionally serve as a closure mechanism. For example, the elastic 56 can be tensioned such that impermeable cover 44 retracts to a closed configuration, when the lining unit 42 is removed from the body liquid receptacle 22 or multi-liner assembly 24.

As can be further appreciated, other attachment and/or closure mechanisms can be provided in addition or in place of the elastic 56. For example, attachment and/or closure mechanisms can include tie-downs, hook and loop fasteners, buttons, snaps, strings (such as a drawstring), adhesives, etc. In some embodiments, closure mechanism can simply include a peripheral region of lining unit 42 configured to fold over rim section 52 to secure to support 40, and/or configured to fold over itself to close the lining unit 42.

In the present embodiment, the lining units 42 include a drawstring 57 (or ribbon) in a peripheral region thereof. As illustrated, the drawstring 57 is contained in a sleeve of a peripheral region of the lining units 42, adjacent the elastic 56. Preferably, the drawstring 57 is spaced apart from the elastic 56, such that elastic is provided in an outermost peripheral region of the lining units 42 and the drawstring 57 is in a peripheral region radially inward relative thereto. The drawstring 57 can be pulled out through an opening of the sleeve, causing the peripheral region of the lining unit 42 to bunch up and close. The lining unit 42 can thus be secured to the engagement support 40 and/or the body liquid receptacle 22 by wrapping the lining unit 42 around the support 40 and/or receptacle 22, and pulling the drawstring 57 to tighten the peripheral region of the lining unit 42 under the rim section 52 of support 40. Moreover, when lining unit 42 is removed from the body liquid receptacle 22 or multi-liner assembly 24, the drawstrings 57 can be pulled to move the lining unit 42 into a closed configuration. Although in the present embodiment the lining unit 42 includes both an elastic 56 and a drawstring 57, it is appreciated that in some embodiments the lining unit 42 can include only an elastic 46 or only a drawstring 57.

In other embodiments, the attachment mechanism can comprise an adhesive on an underside or bottom side of some or all lining units 42, or of the multi-liner assembly 24, for attaching the lining unit 42 or multi-liner assembly 24 to a surface onto which the lining unit 42 or multi-liner assembly 24 is superimposed. In an embodiment, the lining units 42 can have a temporary adhesive provided on a bottom surface thereof, for example on a bottom side of the impermeable layer 44, or on a top side of the impermeable layer 46 of a lining unit 42 positioned thereunder. The adhesive is referred to as temporary in that adhesive can be disengaged and lining unit 42 can be removed without causing damage to the impermeable layer 44, by applying sufficient pulling force on lining unit 42. In this fashion, topmost lining unit 42*u* adheres to a top surface of lining unit 42*c* positioned thereunder. Lining unit 42*c* adheres to lining unit 42*b*, and this continues all the way until bottommost lining unit 42*a* which adheres directly to body liquid receptacle 22 or support 40. Each of the lining units 42 can be individually removed by disengaging its corresponding temporary adhesive. In some embodiments, a removable protective film can be provided on the top side of impermeable layer 44 to cover and protect absorbent material 46. In such embodiments, the adhesive can be provided on a top side of the protective film, or aligned with the protective film on the bottom side of a lining unit 42 superimposed thereon. In this fashion, topmost lining unit 42*u* can adhere to lining unit 42*c* via the protective film. When topmost lining unit 42*u* is removed, the protective film is removed therewith, exposing the absorbent material 46. Subsequent adjacent layers of lining units 42 can be configured in a similar fashion.

In some embodiments, bottommost lining unit 42*a* can be permanently attached to receptacle 22 or support 40. The attachment is said to be permanent in that the adhesive or other attachment mechanism securing bottommost lining unit 42*a* is strong enough such that lining unit 42*a* cannot be removed without damaging impermeable layer 44. In some embodiments, an attachment mechanism can be provided on the engagement support 40 or on the receptacle 22 for securing the bottommost lining unit 42*a*.

In the embodiment shown in FIG. 3, each one of the liquid lining units 42 includes a front removal tab 58*a* and a rear removal tab 58*b* extending outwardly from a periphery thereof. The purpose of which will be described in more detail below. It is appreciated that, in an alternative embodiment, the lining units 42 can be free of removal tabs, can include more removal tabs, such as a lateral tab, or can include only one removal tab, such as either the front removal tab, the rear removal tab or the lateral one. As will be described in more details below, one or more of the removal tabs 58*a*, 58*b* can have adhesive properties.

As mentioned above, each one of the lining units 42*a*, 42*b*, 42*c*, 42*u* also includes the absorbent material layer 46. The absorbent material layer 46 is superposed to an upper surface of the respective one of lining units 42, for example on the liquid impermeable covers 44. Thus, in the embodiment shown, the multi-liner assembly 24 includes four lining units 42*a*, 42*b*, 42*c*, 42*u* wherein 42*u* is the uppermost one of the lining units, and 42*a* is a bottommost one of the lining units. When the multi-liner assembly 24 is mounted to the receptacle engagement support 40 (and optionally when the support 40 is engaged with the body liquid receptacle), the topmost lining unit 42*u* is exposed, whereas subsequent lining units 42*a*-42*c* are covered by the topmost lining unit 42*u*. More particularly, the absorbent material layer 46 of the uppermost lining unit 42*u* is exposed in the cavity 26 and visible from outside, and is thus positioned to receive body liquid in the cavity 26, as shown in FIG. 1. The impermeable cover 44 of topmost lining unit 42*u* prevents body liquid in the cavity 26 from contaminating subsequent lining units 42*a*-42*c* and the body liquid receptacle 22 itself.

It is appreciated that the number and the shape of the lining units 42 of the multi-layer assembly 24 can vary from the embodiment shown. The multi-layer assembly 24 can have two or more superposed lining units 42.

The uppermost lining unit 42*u* is detachable and removable from the remaining ones of the lining units 42 of the multi-liner assembly 24. Once the uppermost lining unit 42 is detached and removed, the lining unit 42*c* extending below and adjacent to the uppermost lining unit 42*u* before detachment and removal becomes the uppermost lining unit of the multi-liner assembly 24 with its absorbent material layer 46 being exposed. The new uppermost lining unit 42*u* is now detachable and removable from the remaining ones of the lining units 42 of the multi-liner assembly 24.

The absorbent material layer 46 can be secured to its respective liquid impermeable cover 44 or can be provided separately and removable from the liquid impermeable cover 44.

Figure 5:
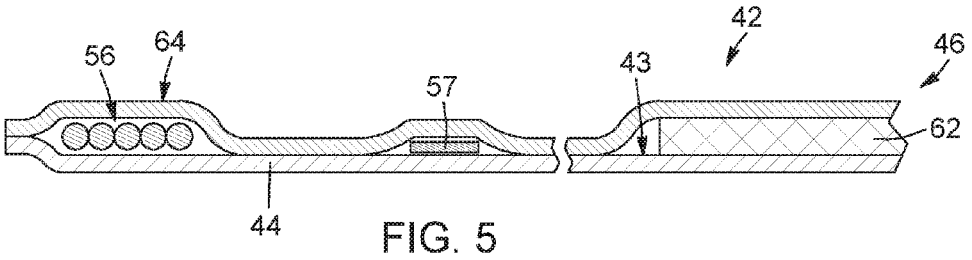
FIG. 5 is a cross-section view of a section of a lining unit of the multi-liner assembly in accordance with an embodiment.

The absorbent material layer 46 is designed to capture liquids and can comprise, for example, a polymer or gel. The absorbent material layer substantially instantaneously holds liquids to ease handling. For example, it can include a superabsorbent polymer, i.e. a polymer that can absorb and retain extremely large amounts of a liquid relative to its own mass. As mentioned above, the absorbent material layer 46 can be a distinct component from the liquid impermeable cover 44 or it can be provided as a single-piece. For example, the gelling agent can be in powder crystal or fiber form, spread out over or stuck to the upper surface of each one of the liquid impermeable covers 44. It can be contained in a sachet which is placed or affixed to the upper surface of each one of the liquid impermeable covers 44. For example, it can be glued. The sachet can be made of a water soluble material or made of a material that is made fragile by the liquid so that it breaks upon contact with it (e.g. paper or cellulose wadding). Alternatively, in the embodiment shown in FIG. 5, the gelling agent particles (not shown) can be inserted into a non-woven material layer 62, such as and without being limitative cellulose pulp fluff, and covered with a top sheet 64, such as and without being limitative a non-woven cellulosic-fiber based tissue sheet. The top sheet 64 is liquid permeable. In an alternative embodiment, the non-woven material layer 62 including the gelling agent particles can be sandwiched between two sheets. In the embodiment shown in FIG. 5, the liquid impermeable cover 44 is used as an impermeable back sheet. The top sheet 64 can cover an entire surface of the liquid impermeable cover 44, or only a portion thereof, with the absorbent material layer 46 being sandwiched inbetween. In an embodiment, the absorbent material layer 46 has a smaller surface area than the liquid impermeable cover 44 and the top sheet 64, if any. In an embodiment, the elastic band 56 and/or drawstring 57 can be sandwiched between the liquid impermeable cover 44 and the top sheet 64, as shown in FIG. 5.

Additional products can be added to the absorbent material layer 46 to improve comfort conditions. For example, it can include deodorants, antiseptics, virucides, antiretroviral, microbicides, bactericides, fungicides, or reagents, etc.

Figure 6:
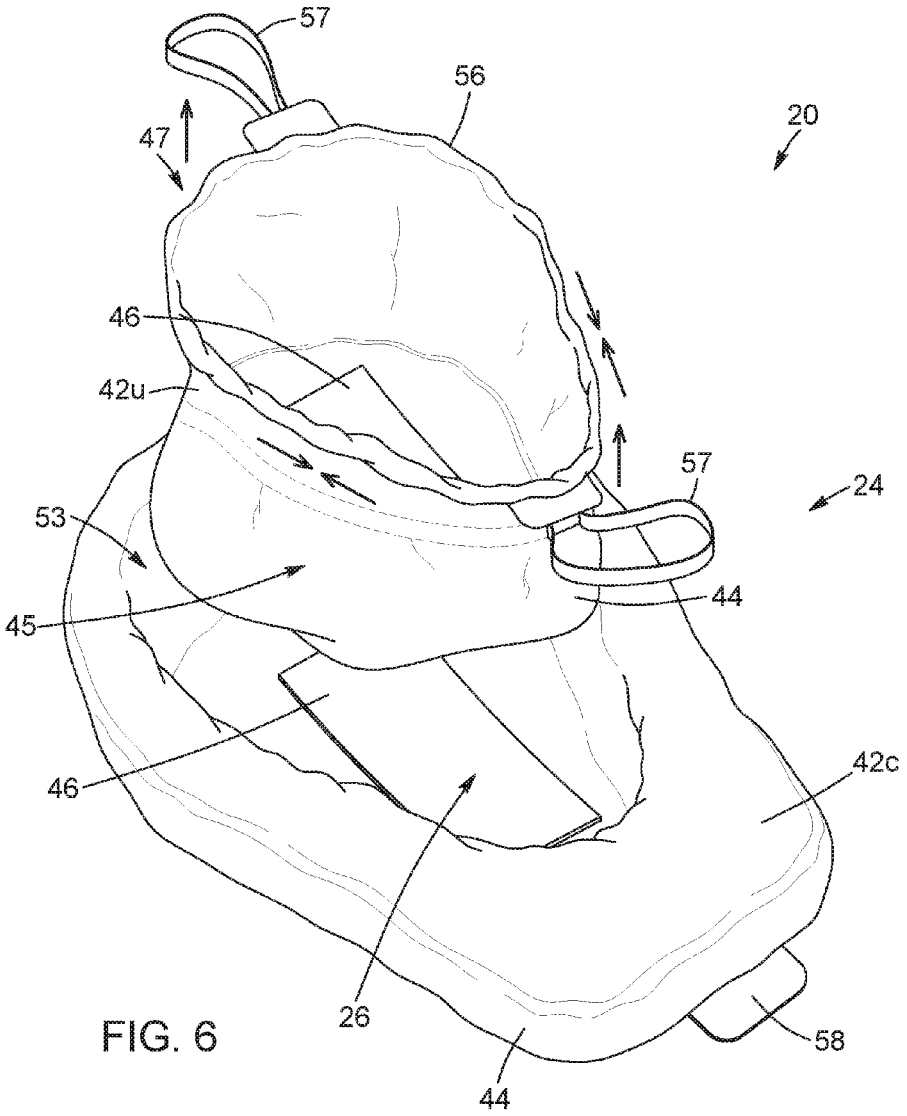
FIG. 6 is a top perspective view of the multi-liner assembly shown in FIG. 1 being engaged with the bedpan with an uppermost of the lining units of the multi-liner assembly being detached and removed.

Turning now to FIG. 6, there is shown that, when used, the multi-liner assembly 24 is engaged with the body liquid receptacle 22. In the embodiment shown, the multi-liner assembly 24 is engaged with the body liquid receptacle 22 by superposing the receptacle engagement support 40 to the body liquid receptacle 22 with aligned cavities 26, 53. When the multi-liner assembly 24 is engaged with the body liquid receptacle 22, the absorbent material layer 46 of the uppermost lining unit 42*u* is exposed in the cavity 26 and the liquid impermeable cover 44 of the uppermost lining unit 42*u* covers the cavity 26. In the embodiment shown, the seat member 34 is covered by the liquid impermeable cover 44 of the uppermost lining unit 42*u* with the elastic band 56 extending under the rim section 52 of the receptacle engagement support 40.

When body liquid is received in the cavity 26, the absorbent material layer 46 of the uppermost lining unit 42*u* absorbs the body liquid and jellifies same. The uppermost lining unit 42*u* can then be individually removed from the multi-liner assembly 24 to leave a subsequent one of the lining units 42 exposed. Preferably, the removal tabs 58 of lining units 42 and/or the openings exposing drawstring 57 are positioned such that the tabs 58 and/or drawstrings 57 of the uppermost lining unit 42*u* are visible and accessible when the multi-layer assembly 24 is engaged with the body liquid receptacle 22. For example, the tab 58 and/or drawstring 57 opening can be positioned on an interior of lining unit 42*u*, so that when peripheral region of lining unit 42*u* is folded back over rim 52, tab 58 and/or drawstring 57 is visible on an exterior side of the receptacle 22, for example on or under rim 52. Alternatively, elastic band 56 can extend at least partially in a peripheral region inward relative to the tabs 58, allowing tabs to hang freely on the exterior of the receptacle 22 when the elastic band 56 is engaged with the receptacle 22 and/or support 40. In this fashion, uppermost lining unit 42*u* can be detached from the other ones of the lining unit 42*a*, 42*b*, 42*c* by pulling one or more of the removal tabs 58*a*, 58*b* and/or by pulling drawstring 57 to stretch the elastic band 56 and pull the liquid impermeable cover 44 of the uppermost lining unit 42*u* above the seat member 34. Once detached from the remaining lining units of the multi-layer assembly 24, the detached lining unit 42*u* is a pouch with an open mouth defined by the elastic band 56 and/or drawstring 57 as shown in FIG. 6. The absorbent material layer 46 is contained in the bottom of the pouch with any free liquid. The resilient properties of the elastic band 56 in the peripheral region of the lining unit 42 and/or pulling the drawstring 57 closes the open mouth of the pouch to reduce body liquid spillage, as shown by the arrows in FIG. 6.

Figure 7:
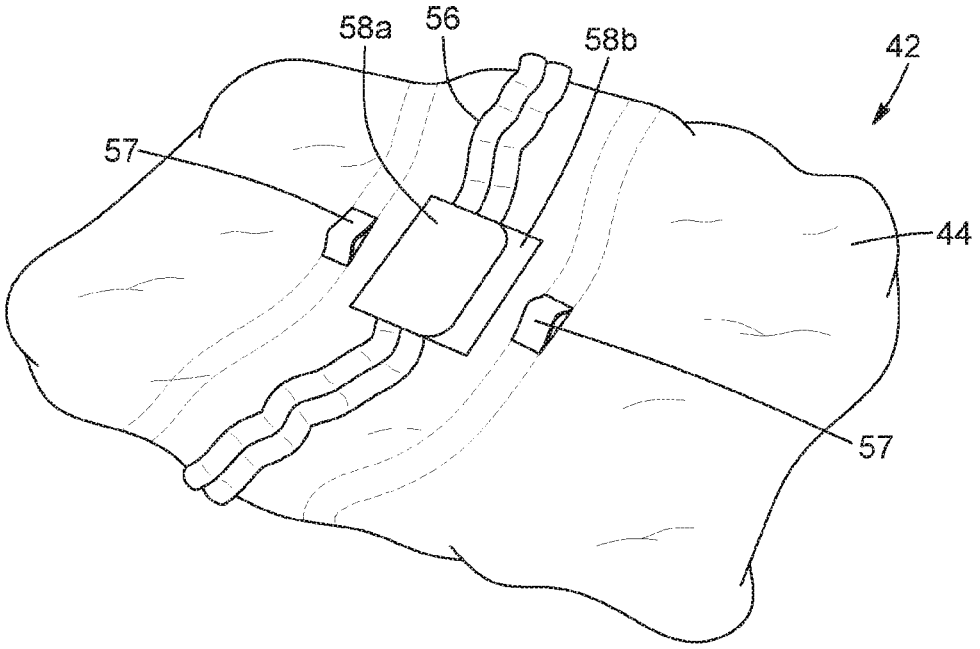
FIG. 7 is a top perspective view of the lining unit of the multi-liner assembly, in a closed configuration following removal from the multi-liner assembly, in accordance with an embodiment in which the lining unit is closeable via an adhesive on the removal tabs.
Figure 8C:
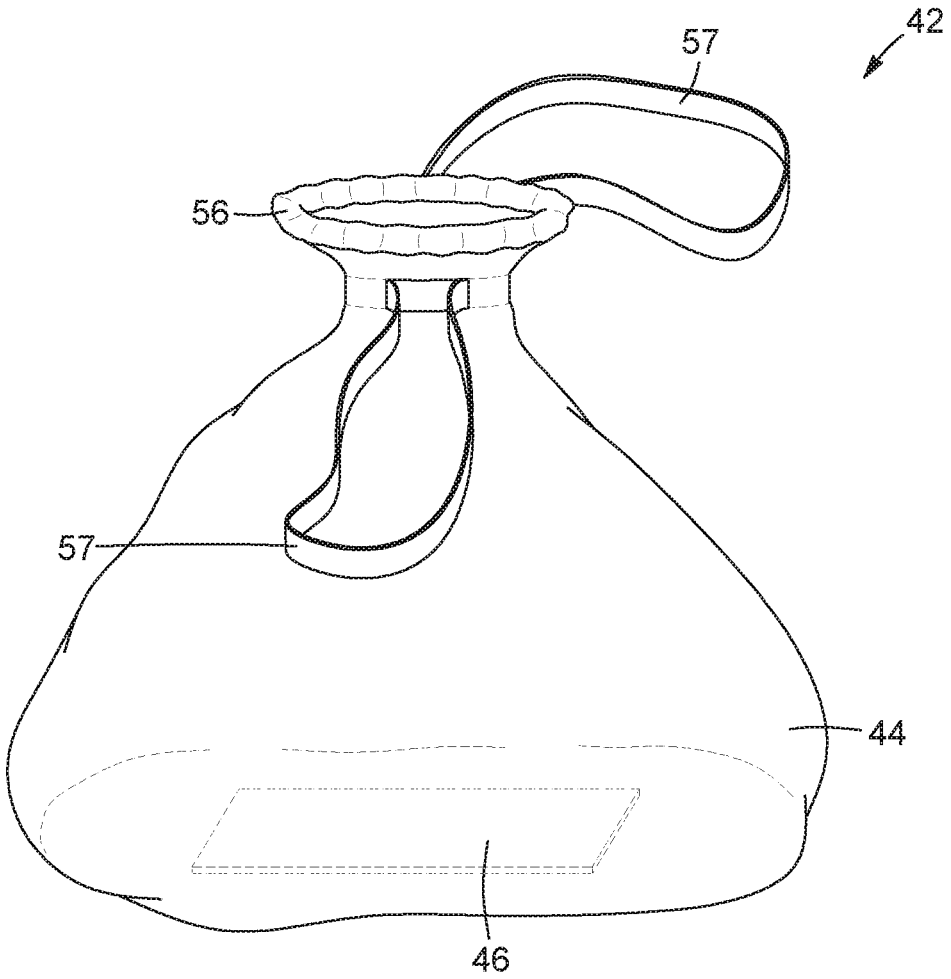
FIG. 8C is a perspective view of the lining unit of FIG. 8A in a closed configuration following removal from the multi-liner assembly.
Figure 8D:
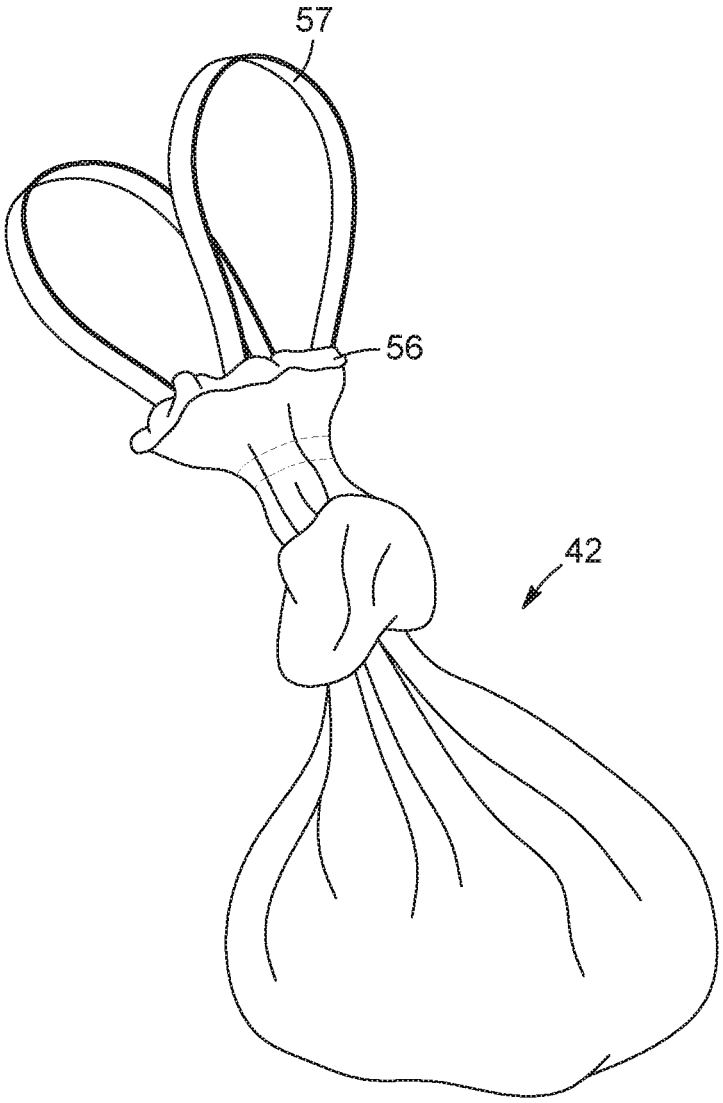
FIG. 8D is a perspective view of the lining unit of FIG. 8A in a closed configuration following removal from the multi-liner assembly, in accordance with an embodiment in which the lining unit is closeable via a knot.

The lining units 42, detached and removed, can then be closed using a closure mechanism to prevent access to the absorbent material layer 46 and disposed. For example, the closure mechanism can comprise an adhesive on a first end 59*a* and/or second end 59*b* of the lining unit 42, for example on at least one of the removal tabs 58*a*, 58*b*. The adhesive can be used to close the removal tabs 58*a*, 58*b* as shown in FIG. 7. For instance, the peripheral region of lining unit 42 can be folded closed, and the tab with the adhesive on one side can be folded over and adhered to the opposite side of lining unit 42 to secure the sides together and close the lining unit. In some embodiments, for example if the liquid impermeable cover 44 includes two removal tabs 58*a*, 58*b*, the liquid impermeable cover 44 can be closed by superposing the two removal tabs 58*a*, 58*b* and applying a slight pressure thereon, as shown in FIG. 7. In some embodiments, for example when the closure mechanism includes a drawstring 57, the drawstring 57 can be pulled to completely close off a top portion of the lining unit 42, as shown in FIG. 8C. The top portion can further be tied in a knot to prevent body liquid contained therein from escaping, as shown in FIG. 8D.

As shown in FIG. 6, when the uppermost lining unit is removed, the lining unit 42*c* extending below and adjacent to the uppermost lining unit 42*u* before detachment and removal becomes the uppermost lining unit of the multi-liner assembly 24 engaged with the body liquid receptacle 22 with its absorbent material layer 46 being exposed. The body liquid receptacle 22 can be used again without requiring to be cleaned or insertion and engagement of another lining assembly. The similar steps can be carried out until the multi-liner assembly 24 is empty of lining unit 42.

It is appreciated that, in an alternative embodiment, the multi-liner assembly 24 can be free of receptacle engagement support 40 and that the superposed lining units 42 can be engaged directly with the body liquid receptacle 22. A lowermost one of the superposed lining units 42 can include an adhesive, such as a peelable adhesive, which can be activated when engaged with the body liquid receptacle 22, as described above. In some embodiments, also as described above, each of the lining units 42 in the multi-liner assembly 24 can be temporarily adhered to one another. The bottommost lining unit 42*a* can then be permanently or temporarily attached to the body liquid receptacle 22 directly. In some embodiments, each lining unit 42 can have its peripheral section wrapped directly around rim section 36 of receptacle 22. More lining units 42 can be added afterwards to provide more removable layers as necessary.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A multi-liner assembly for lining a body liquid receptacle, the multi-liner assembly comprising a plurality of lining units superimposed on one another and engageable with the body liquid receptacle to line a cavity formed therein; and a rigid support having a receptacle-facing surface and a top surface, opposed to the receptacle-facing surface, the rigid support being located under a bottommost one of the lining units to support the lining units, and being removably engageable with the body liquid receptacle, each of the plurality of lining units comprising an impermeable layer having a top side with an absorbent material superposed thereon, wherein each one of the lining units comprises a free edge delimiting an open mouth with the free edge extending along the receptacle-facing surface of the rigid support with a section of each one of the lining units lining the top surface to maintain each one of the lining units in an open configuration, wherein, when the rigid support of the multi-liner assembly is engaged with the body liquid receptacle, a topmost one of the plurality of lining units is exposed and is individually removable from the multi-liner assembly to leave a subsequent one of the plurality of lining units exposed.

2. The multi-liner assembly according to claim 1, wherein at least one of the lining units comprises an attachment mechanism extending at least partially along the free edge and configured to removably secure the at least one lining unit to the body liquid receptacle.

3. The multi-liner assembly according to claim 2, wherein the attachment mechanism comprises an elastic extending at least partially around the free edge of the at least one lining unit and biasing the free edge of the at least one lining unit against the receptacle-facing surface of the rigid support.

4. The multi-liner assembly according to claim 2, wherein the attachment mechanism comprises an adhesive exposed on a bottom side of the at least one lining unit.

5. The multi-liner assembly according to claim 1, wherein each of the plurality of lining units comprises at least one removal tab extending from a periphery thereof, the removal tab of at least the topmost lining unit being exposed when the multi-liner assembly is engaged with the body liquid receptacle.

6. The multi-liner assembly according to claim 1, wherein each of the plurality of lining units comprises a closure mechanism operable to close the lining unit and enclose the absorbent material therein.

7. The multi-liner assembly according to claim 6, wherein each of the plurality of lining units comprises a first end and a second end, and wherein the closure mechanism comprises an adhesive provided in at least one of the first and second ends of the lining unit, the lining unit being closable by folding the first end over the absorbent material and towards the second end, and securing the first and second ends together using the adhesive.

8. The multi-liner assembling according to claim 1, wherein each of the lining units comprises a bottom section insertable into the cavity of the body liquid receptacle, and an upper section shaped to wrap around a seat section of the body liquid receptacle to engage therewith.

9. The multi-liner assembling according to claim 1, wherein the rigid support further comprises a seat member section and a rim section extending downwardly from the seat member section, the top surface of the seat member section and the rim section being covered by the lining units with the free edge extending along the receptacle-facing surface of the rim section.

10. A liner assembly for lining a body liquid receptacle, the liner assembly comprising:

a rigid support having a receptacle-facing surface and a top surface and being removably engageable with the body liquid receptacle; and at least one lining unit supported by the rigid support, the at least one lining unit comprising an impermeable layer having a top side with an absorbent material superposed thereon, wherein the at least one lining unit comprises a free edge delimiting an open mouth with the free edge extending along the receptacle-facing surface of the rigid support with a section of the at least one lining unit lining the top surface to maintain the at least one lining unit in an open configuration;

wherein, when the rigid support is engaged with the body liquid receptacle, the top side of the at least one lining unit is exposed and positioned to line a cavity formed in the body liquid receptacle.

11. The liner assembly according to claim 10, wherein the rigid support is at least partially complementary in shape to the body liquid receptacle with which it engages.

12. The liner assembly according to claim 10, wherein the rigid support is substantially ring shaped.

13. The liner assembly according to claim 10, wherein the free edge of the at least one lining unit is biased against the receptacle-facing surface of the rigid support.

14. The liner assembly according to claim 10, wherein the rigid support comprises a peripheral wall section, a seat member section and a rim section and, when the rigid support is engaged with the body liquid receptacle, said peripheral wall section, seat section and rim section are superposed to a corresponding peripheral wall, seat member and rim of the body liquid receptacle with the free edge of the at least one lining unit extending between the rim section of the rigid support and the rim of the body liquid receptacle.

15. The liner assembly according to claim 10, wherein the rigid support has a cavity defined therein and the at least one lining unit is positioned to cover said cavity, and wherein the cavity of the rigid support is aligned with the cavity of the body liquid receptacle when the rigid support is engaged therewith, the at least one lining unit thereby covering the cavity of the body liquid receptacle when the body liquid receptacle is engaged with the rigid support.

16. The liner assembly according to claim 15, wherein the cavity in the rigid support is defined by a peripheral wall section and, when the rigid support is engaged with the body liquid receptacle, said peripheral wall section is superposed to a corresponding peripheral wall in the body liquid receptacle.

17. The liner assembly according to claim 10, wherein the rigid support comprises a rim section and a seat member section with the rim section extending downwardly from the seat member section, and wherein, when the rigid support is engaged with the body liquid receptacle, the seat member section is superposed to a seat member of the body liquid receptacle and the free edge of the at least one lining unit is biased against the receptacle-facing surface of the rim section.

18. The liner assembly according to claim 10, wherein the rigid support comprises a body made of a molded plastic or pulp.

19. The liner assembly according to claim 10, wherein the at least one lining unit comprises a plurality of lining units superimposed on one another with the rigid support being located under a bottommost one of the lining units, supporting the plurality of lining units, wherein, when the liner assembly is engaged with the body liquid receptacle, a topmost one of the plurality of lining units is exposed, said topmost one of the plurality of lining units being individually removable from the liner assembly to leave a subsequent one of the plurality of lining units exposed.

20. A body liquid receptacle assembly comprising a body liquid receptacle having a body with a cavity defined therein, and a multi-liner assembly removably engaged with the body liquid receptacle; the multi-liner assembly comprising a rigid support having a receptacle-facing surface and a top surface and being removably engageable with the body liquid receptacle; and a plurality of lining units superimposed on one another and engaged with the body liquid receptacle to line the cavity, each of the plurality of lining units comprising an impermeable layer having a top side with an absorbent material superimposed thereon, the rigid support being located under a bottommost one of the lining units and supporting the lining units, wherein each one of the lining units comprises a free edge delimiting an open mouth with the free edge extending along the receptacle-facing surface of the rigid support, inbetween the rigid support and the body of the body liquid receptacle, with a section of the at least one lining unit lining the top surface to maintain the lining units in an open configuration, wherein a topmost one of the plurality of lining units is exposed and is individually removable from the multi-liner assembly to leave a subsequent one of the plurality of lining units exposed.

* * * * *